United States Patent [19]

Wooldridge et al.

[11] 4,135,471

[45] Jan. 23, 1979

[54] COMBINATION KNOB AND DIAL CONTROL FOR COLD CONTROL DEVICES

[75] Inventors: Darrel Wooldridge, Los Angeles; Eugene T. McKinnon, Pacific Palisades, both of Calif.

[73] Assignee: Gem Products, Inc., Santa Monica, Calif.

[21] Appl. No.: 844,804

[22] Filed: Oct. 25, 1977

[51] Int. Cl.[2] ..... G05G 1/12; G09F 9/40

[52] U.S. Cl. ..... 116/366; 74/553

[58] Field of Search ..... 116/115, 124 A, 133, 116/124.2 A, 129 F, 129 R; 74/553, 10.22; 16/121

[56] References Cited

U.S. PATENT DOCUMENTS

| | | | |
|---|---|---|---|
| 1,446,652 | 2/1923 | Morris | 74/553 |
| 2,082,091 | 6/1937 | Adams | 74/553 |
| 3,241,515 | 3/1966 | Franklin | 116/115 |
| 3,329,452 | 7/1967 | Ammon | 74/553 |
| 3,410,247 | 11/1968 | Dronberger | 116/133 |
| 3,769,933 | 11/1973 | Fox | 116/133 |
| 3,902,375 | 9/1975 | Herrick | 74/553 |

*Primary Examiner*—S. Clement Swisher
*Assistant Examiner*—Denis E. Corr
*Attorney, Agent, or Firm*—Mahoney, Schick & Cislo

[57] ABSTRACT

A universal, knob-dial control member for association with the control shaft of a cold control regulator wherein the knob member is uniquely configured so as to be adaptable to be used on a plurality of cold control regulators in and of itself or alternately, adapted to have the dial member disassociatible which accommodates still other cold control regulators. The provision of the knob-dial control member in kit form, having selectable knob members, provides a means whereby inventory is substantially reduced and a service man has the ability to service a large number of cold control regulators without the need of having a large number of specialty repair and replacement parts.

8 Claims, 11 Drawing Figures

COMBINATION KNOB AND DIAL CONTROL FOR COLD CONTROL DEVICES

BACKGROUND OF THE INVENTION

In the after-market where it is necessary to provide replacement parts and services for servicing original equipment manufactured goods, those suppliers of such goods for the after-market are confronted with a two-fold problem. Firstly, original equipment manufacturers utilize their own unique design and produce original equipment having specific configurations which requires that replacement parts for the original equipment be specially designed to be adaptable therewith. The after-market manufacturer is confronted additionally with the need to stock repair and replacement parts that are unique and specifically adapted for association with one particular original manufacturer's goods.

To specifically manufacture repair and replacement parts identical to those of the original equipment manufacturer, may, in some instances, present proprietary encroachment or, as is most often the case, present the after-market manufacturer with having to produce a large assortment of repair and replacement parts which have a relatively low volume, thereby making it economically infeasible to adequately service the after-market needs. Secondly, even if specific uniquely configured after-market, replacement parts were to be manufactured, the cost of warehousing and making said specific parts available would become uneconomical and cumbersome, not to mention the difficulties that, for example, a service man would have with regard to making calls not knowing what repair and replacement parts he should have on hand.

Considering the foregoing problems with regard to refrigeration equipment such as refrigerators, freezers and the like, all of which contain cold control regulators, the present invention pertains to a universal, cold control knob and dial replacement part which will overcome many of the foregoing shortcomings alluded to with regard to after-market replacement parts. The universal knob-dial control member of the invention is uniquely configured so that the knob itself may be utilized alone and is adapted to accommodate the control shaft of a large number of cold control regulators or, alternately, is adapted to be associated with a dial member for still other cold control regulators of various original equipment manufacture.

The universal knob-dial control member of the invention not only makes it economically feasible for the after-market manufacturer to supply replacement parts to meet the needs of a plurality of devices needing replacement parts, but also facilitates the repair man's ability to service the original equipment manufactured devices in that one universal, cold control knob-dial combination or kit allows him to service a plurality of cold control devices with but a single knob-dial control member.

OBJECTS AND SUMMARY OF THE INVENTION

It is an object of the invention to provide a universal knob-dial control member for association with cold control regulators.

It is another object of the invention to provide a knob-dial control member which has versatile application to a myriad of different types of cold control devices.

It is another important, further object of the invention to provide a knob-dial control member for association with the control shaft of a cold control regulator, which may be used in and of itself as a replacement part or in combination with a dial member wherein ease of association and retention is obtained.

It is still even a further, more specific object of the invention to provide a combination knob-dial control member which is associable either singly or in combination with various types of cold control regulators, wherein the knob-dial control member is adaptable for various types of cold control regulator devices and wherein the knob may be used by itself or in combination with a dial member as a replacement assemblage.

It is another even further, still more specific, object of the invention to provide a knob-dial control member for association with a control shaft of a cold control regulator wherein the knob member has a specific, unique configuration for ease of application and association with the control shaft or other regulatory means of a cold control device.

It is still another and even more further specific object of the invention to provide a universal cold control knob and dial combination which employs a knob member having a central boss which is of selectable size and which is adapted to become associated, in retained manner, with the control element of a cold control regulator device and wherein the same knob member with locking pins may be associated with a concentrically configured dial member for association with still other cold control members.

In an exemplary embodiment, the invention is directed to a universal knob-dial control member for association with the control shaft or other regulatory means of a cold control regulator device comprising the combination of a knob member having an exterior, polygonal, planar portion and a circumferential skirt portion and having an interior recess portion with an integral, centrally extending boss. The boss has a central bore and is adapted to receive the control shaft or other regulatory means of a cold control regulator and the interior recessed portion is provided with spaced locking pins adapted for releasable engagement with a dial member if desired, or said knob member is adaptable for being used alone.

In still another embodiment of the invention, the hereinbefore described knob control member is associated with a dial member of larger, congruent configuration than said knob member, wherein the dial member has a first, planar portion terminating in a circumferential skirt portion and has an inner-set, central, upraised portion with a central apperture and a circumscribing, second planar portion having a plurality of spaced holes, at least equal in number to the number of locking pins carried by said knob member, whereby said knob member may be snap fitted into retained position over said inner-set, central upraised portion for releasable locking association therewith.

The foregoing exemplary objects and embodiments of the invention will become apparent when taken into conjunction with the figures of drawing and the hereinafter following commentary.

DESCRIPTION OF THE BEST EMBODIMENT CONTEMPLATED

Figure 1:
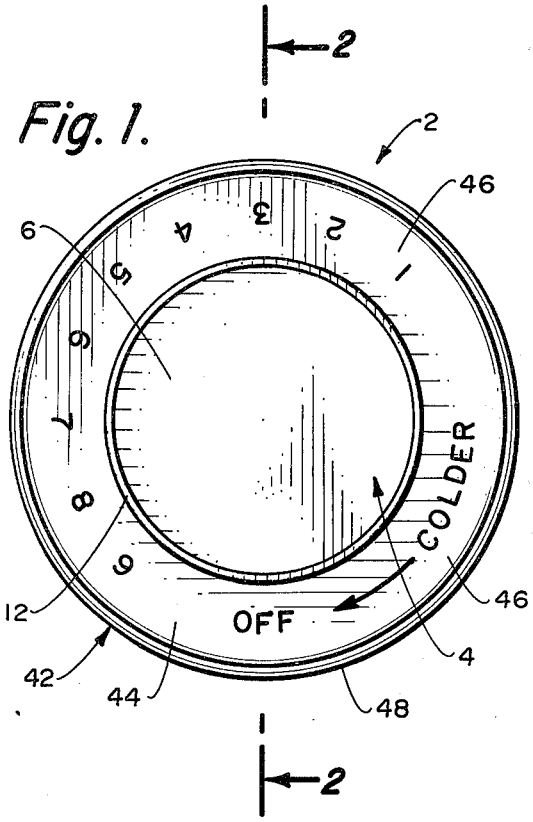
FIG. 1 is a front view of one embodiment of the invention illustrating the universal knob-dial control member in association with a cold control regulator device.
Figure 2:
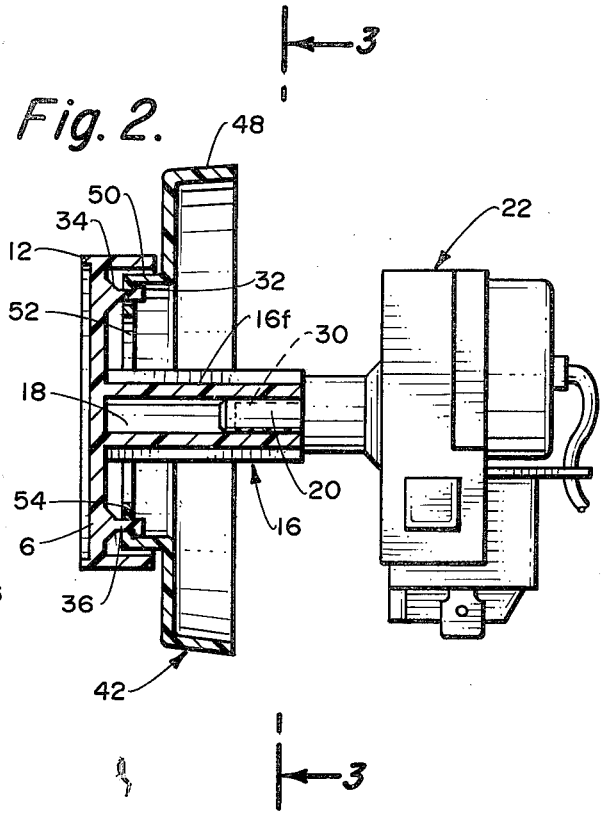
FIG. 2 is a view taken along the line 2—2 of FIG. 1.

Referring to the figures of drawing wherein like numerals of reference designate like elements throughout, it will be seen that the one form of universal knob-dial control member 2 comprises a first member 4 which, in this particular instance, is of molded plastic, and is composed of an exterior polygonal or annular planar portion 6 integrally connected to a circumferential skirt portion 8, in this instance, having a number of serrations 10 to provide ease of manipulating the knob member 4.

About the edge of planar portion 6 which is slightly recessed with regard to skirt portion 8, a peripheral lip or edge 12 is provided to accommodate if desired, a label having printed indicia thereon and which embodiment will be further described hereinafter.

The interior surface 14 of planar portion or wall 6 is provided with an integral, centrally extending boss 16 having a central bore 18 of sufficient diameter to receive, for example, the control shaft 20 of cold control regulator device 22.

Figure 9:
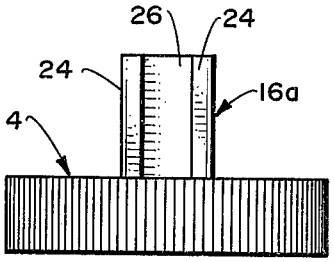
FIGS. 9, 10 and 11 illustrate the knob member illustrated in FIG. 5 showing various lengths of the central boss portion for accommodation as a replacement part with various original equipment manufacture cold control devices.
Figure 10:
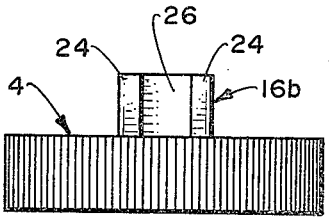
Figure 11:
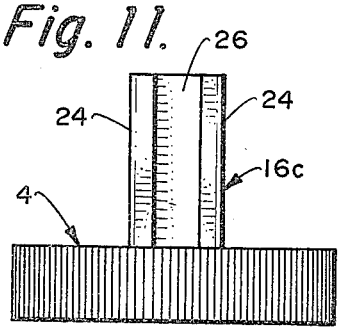

The length of central, upstanding boss 16 is of selective length so as to accommodate itself to the particular type of cold control device 22 and in particular, the housing or cabinet wall, not shown, that would surround and be supportive to cold control device 22. Thus, a plurality of knob members 4 may be provided with varying boss lengths, i.e. 16*a*, 16*b*, 16*c* as illustrated in FIGS. 9, 10 and 11, or alternately, a length may be selected such as 16*c*, which, because of the fact that the knob member 4 is of molded plastic, may be cut or sawed to appropriate length for combination with the particular cold control regulator device 22.

The boss 16 is somewhat rectangular in shape and is provided with two adjacent flat sides 16*f* and adjacent grooved surfaces 16*g* by reason of the fact that channel extensions 24 are provided so as to form two main channels or grooves 26 and 28 which are adapted to receive flat spring or plate-like members 30 associated in parallel relationship to shaft 20 of cold control regulator device 22. In some instances, as will be seen hereinafter, the particular cold control device may utilize a plurality of spaced apart plates and in each instance, said plates or spring clips, are designed to ensure a friction fit association, or locking engagement between the control shaft, for example, 20 and the knob member 4.

Spaced about the integral central boss 16 are integral locking pins 32, in this particular instance, equally spaced about the interior surface of knob member 4 and being 90° apart. The locking pin members 32 have a conical portion 34 terminating in a shaft portion 36 and having a slight protuberance or triangular shaped locking end 36 for association with a dial member as will now be explained.

Dial member 42 comprises a larger and congruently configured element than said knob member 4 and has a first, annular, planar portion 44 having heat stamped, in this instance, indicia 46 thereon and having a depending or circumscribing skirt portion 48, in this particular instance being of smooth wall finish as opposed to being serrated, as in the case of knob member 4. The first planar portion 44 is integral with an inner set, central, upraised portion 50 having a central aperture or bore 52 of a size to accommodate the knob member 4 in combined association as will now be detailed.

Figure 3:
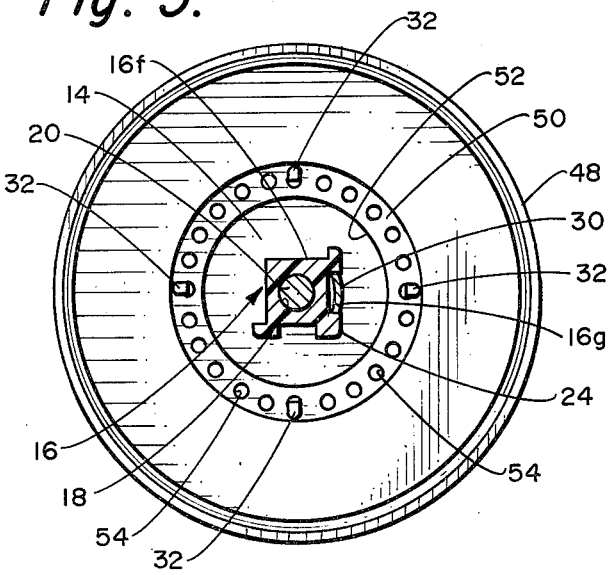
FIG. 3 is a view taken along the line 3—3 of FIG. 2.
Figure 4:
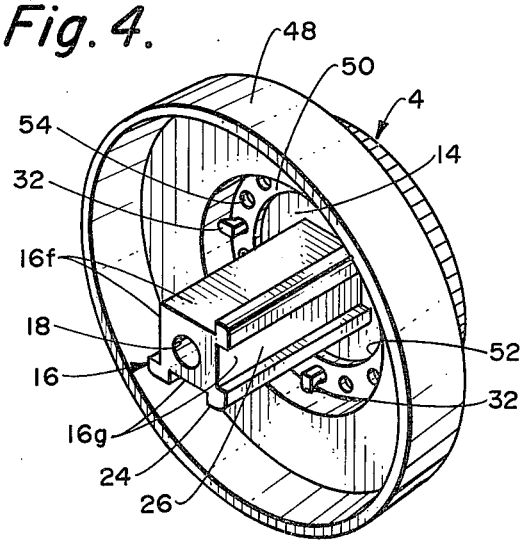
FIG. 4 is a rear, perspective view of the one embodiment of the universal knob-dial control member illustrated in FIGS. 1, 2 and 3.
Figure 5:
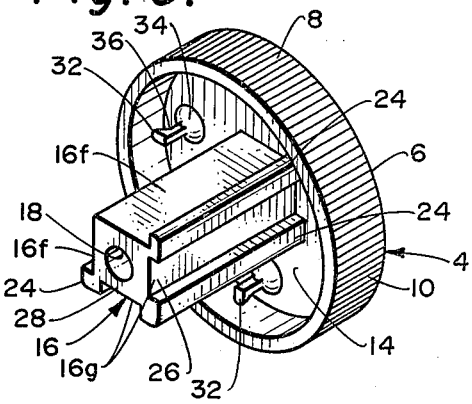
FIG. 5 is a rear, perspective view of the knob member alone.
Figure 6:
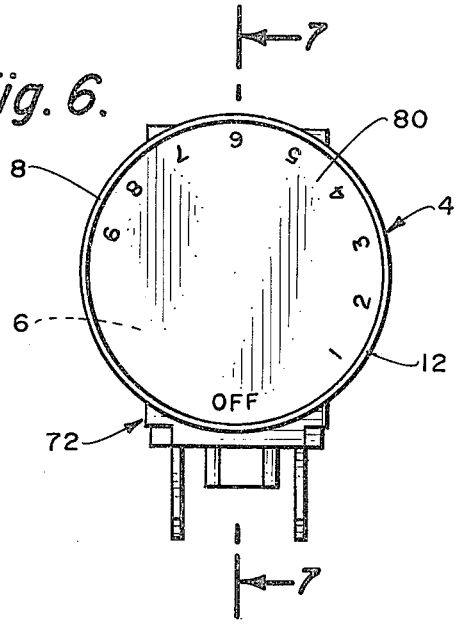
FIG. 6 is a front view of the knob control member alone illustrated in FIG. 5 being associated with a cold control regulator device.

The second, inner-set, planar portion 50 has a diameter slightly less than the internal or inside diameter of the knob member 4 and more specifically of the skirt wall portion 8 so that skirt wall portion 8 and knob member 4 will fit over central upraised portion 50 of dial member 42. The planar portion 50 is provided with a plurality of spaced holes or apertures 54 which are of a size to receive the locking pins 32 on the interior surface 14 of knob member 4 as best seen in FIGS. 3 and 4.

The knob-dial control member assemblage 2 is ready for association with a shaft of a cold control regulator device merely by associating the knob member 4 with the dial member 42 making sure that the indicia 46 of dial member 42 is appropriately positioned with regard to the exterior or cabinet of the refrigeration unit and thereafter snap fitting, or pushing on, the knob-dial control member 2 onto the control shaft 20, for example, of cold control regulator 22 making sure that the spring or clip member 30 is approriately lined up within the selected groove or flat of boss member 16.

Figure 7:
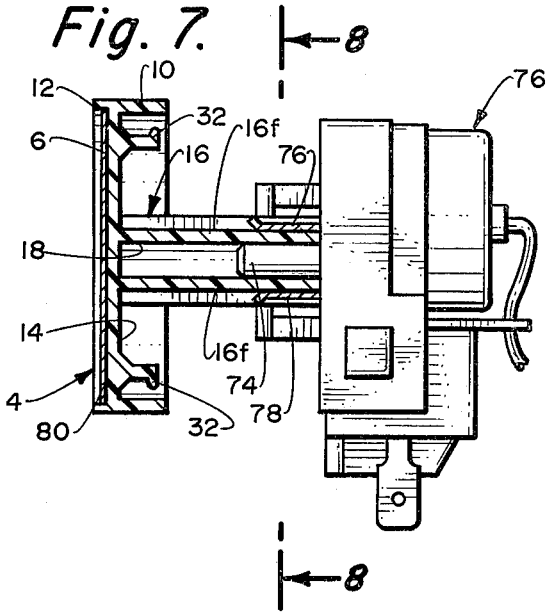
FIG. 7 is a view taken along the line 7—7 of FIG. 6.
Figure 8:
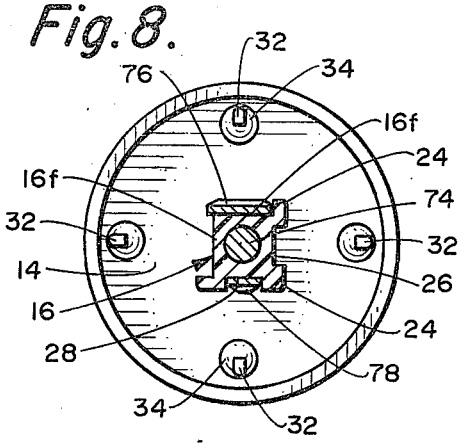
FIG. 8 is a view taken along the line 8—8 of FIG. 7.

Referring now to FIGS. 5, 6, 7 and 8, it will be seen how the knob member 4 may be used by itself without the need of dial member 42. An identical knob member 4 as heretofore described, in this instance, is adapted to be associated with a cold control regulator member 72 which, in addition to a control shaft 74, is provided with opposed spring or clip members 76 and 78 for reception and accommodation onto the flats or grooved surfaces of boss 16 as illustrated in FIGS. 7 and 8.

In this instance, because the knob member 4 is not intended to be associated with a dial member 42, a decal or other label 80, such as one having a pressure sensitive adhesive, may be applied to the surface 6 of the knob control member within the outer rim or edge 12.

Obviously, where desired, the knob member 4 may be already imprinted or have a heat stamp thereon to illustrate the various indicia information which is shown as being imprinted on the label or decal 80, but this could be in conflict with indicia 46.

In this particular instance, the knob member 4 is prepared for reception with the cold control unit 72 by having the label 80 appropriately positioned thereon and thereafter, the shaft end spring clips 76 and 78 properly aligned and the knob member pushed onto the shaft 74 to be retained thereon with the cooperation of spring clips 76 and 78.

Obviously, in order to remove either the knob 4 from association with the cold control regulator device 72, a reverse pulling action is employed and with regard to the knob-control member 2, the same would be true since a forward pushing on action positions the knob-dial control member onto the shaft 20. Additionally, to remove the knob 4 from association with the dial 42 an outward thrusting action, upon the inside surface 50, will allow for disengagement of the locking pins 32 from the associated aligned apertures 54 thereby releasing knob member 4 from cooperative snap fit association with dial member 42.

While a specific design, materials and configuration has been illustrated for the knob-dial control member of the invention, those of ordinary skill in the art will recognize that certain changes and modifications can be made, but such changes and modifications will not depart from the essence and spirit of the invention as disclosed herein in that a unique knob-dial control member as a replacement part for a plurality of O.E.M. manufactured devices has been provided, all in an economically feasible and manipulatable manner and consequently, any minor changes and/or modifications embracing the herein disclosed essence and spirit of the invention will not depart from the claims invention as set forth in the appended claims.

It is thus seen that the unique combination of elements have been associated to fulfill a plurality of needs with regard to replacement parts for original equipment manufactured cold control devices. Not only does the knob-dial control member of the invention fulfill the ability of being able to be associated with manufactured devices of different origins, but the invention lends itself for ease of servicing original equipment manufactured devices, all in a unique and practicable manner.

We claim:

1. A universal knob-dial control member for association with the control shaft of a cold control regulator comprising the combination of: a knob member having an exterior, polygonal, planar portion and a circumferential skirt portion and an interior recessed portion having an integral, centrally extending boss, said boss having a central bore and being adapted to receive a control shaft of a cold control regulator, said interior recessed portion having spaced, locking pins adapted for selective releasable engagement with a dial member, said locking pins being integral with said interior recessed portion and have protuberances, at the terminii thereof and extending a distance less than the depth of said skirt portion.

2. The control member in accordance with claim 1 wherein said planar portion is annular in configuration and said boss is provided with adjacent sides forming grooves and flats to accommodate a myriad of control shaft configurations.

3. The control member in accordance with claim 2 wherein said boss is of selective length to permit mounting of said control member a selected distance from the front housing supporting said cold control regulator.

4. The control member in accordance with claim 3 wherein said knob member is of molded plastic, said planar surface is recessed with respect to said circumferential skirt portion and said circumferential skirt portion has a serrated surface for ease of manipulation.

5. The control member in accordance with claim 1 including a dial member of larger, similar configuration as said knob member and having a first planar portion terminating in a circumferential skirt portion and an inner-set, central, upraised portion having a central aperture and a circumscribing second planar portion having a plurality of spaced holes at least equal in number to said locking pins of said knob member whereby said knob member may be snap fitted over said inner-set, central upraised portion for releasable, locking association therewith.

6. The control member in accordance with claim 5 wherein said plurality of spaced holes are annular in configuration.

7. The control member in accordance with claim 6 wherein said first planar portion has control indicia thereon.

8. The control member in accordance with claim 7 wherein said dial member is integrally fabricated of plastic.

* * * * *